US008511530B2

(12) United States Patent
Yonekawa et al.

(10) Patent No.: US 8,511,530 B2
(45) Date of Patent: Aug. 20, 2013

(54) STAPLER AND STAPLE

(75) Inventors: Ken Yonekawa, Moriya (JP); Isao Itagaki, Nagareyama (JP)

(73) Assignee: Canon Finetech Inc., Misato-shi (JP)

( * ) Notice: Subject to any disclaimer, the term of this patent is extended or adjusted under 35 U.S.C. 154(b) by 904 days.

(21) Appl. No.: 12/114,110

(22) Filed: May 2, 2008

(65) Prior Publication Data

US 2008/0277444 A1 Nov. 13, 2008

(30) Foreign Application Priority Data

May 10, 2007 (JP) ..... 2007-125985
Oct. 22, 2007 (JP) ..... 2007-274248

(51) Int. Cl.
*B25C 5/16* (2006.01)
*B25C 5/02* (2006.01)

(52) U.S. Cl.
USPC ..... 227/120; 227/114; 227/124; 227/135

(58) Field of Classification Search
USPC ..... 227/120, 122, 124, 114, 135, 155; 59/71
See application file for complete search history.

(56) References Cited

U.S. PATENT DOCUMENTS

| | | | | |
|---|---|---|---|---|
| 1,939,631 | A | 12/1933 | Randall | 59/77 |
| 2,154,306 | A * | 4/1939 | Goodstein | 59/71 |
| 2,716,749 | A * | 9/1955 | Timmerbeil | 227/109 |
| 3,757,629 | A * | 9/1973 | Schneider | 411/443 |
| 3,807,619 | A * | 4/1974 | Doyle | 227/83 |
| 3,958,738 | A * | 5/1976 | Tremblay | 227/109 |
| 4,014,492 | A * | 3/1977 | Rothfuss | 227/19 |
| 4,328,918 | A | 5/1982 | Yoshida | |
| 4,340,331 | A * | 7/1982 | Savino | 411/457 |
| 4,598,852 | A * | 7/1986 | Olesen | 227/119 |
| 4,623,082 | A * | 11/1986 | Kurosawa | 227/7 |
| 4,718,803 | A * | 1/1988 | Reitze | 411/476 |
| 4,732,309 | A * | 3/1988 | Judge | 227/109 |
| 4,874,122 | A * | 10/1989 | Froelich et al. | 227/19 |
| 5,009,355 | A * | 4/1991 | Akizawa et al. | 227/114 |
| 5,269,451 | A * | 12/1993 | Udagawa et al. | 227/120 |

(Continued)

FOREIGN PATENT DOCUMENTS

| | | |
|---|---|---|
| JP | 55-73206 A | 6/1980 |
| JP | 60-011778 U | 1/1985 |

(Continued)

*Primary Examiner* — Hemant M Desai
*Assistant Examiner* — Gloria R Weeks
(74) *Attorney, Agent, or Firm* — Fitzpatrick, Cella, Harper & Scinto

(57) ABSTRACT

A stapler includes an enclosing portion that encloses staples, a clinch portion that bends a staple, and a projecting portion that projects the staple from the enclosing portion, inserts the staple to a sheet bundle, and bends the staple in cooperation with the clinch portion to bind the sheet bundle. In addition, a guide portion guides the staple projected by the projecting portion toward the sheet bundle. The guide portion has guide surfaces for guiding the staple from an inlet adapted to receive the inserting ends of the staple to an outlet that is formed narrower than the inlet such that the staple is projected by the projecting portion toward the sheet bundle side, and the projecting portion projects the staple to the guide portion, moves the staple along the guide surfaces to deform the staple in a horseshoe shape, inserts the pair of inserting ends to the sheet bundle, and bends the staple in cooperation with the clinch portion to bind the sheet bundle.

3 Claims, 13 Drawing Sheets

(56) References Cited

U.S. PATENT DOCUMENTS

| | | | | | |
|---|---|---|---|---|---|
| 5,337,945 | A * | 8/1994 | Fehrle et al. | 227/109 |
| 5,346,114 | A * | 9/1994 | Udagawa et al. | 227/120 |
| 5,497,931 | A * | 3/1996 | Nakamura | 227/109 |
| 5,575,415 | A * | 11/1996 | Sucher | 227/109 |
| 5,580,066 | A * | 12/1996 | Jairam | 227/123 |
| 5,639,007 | A * | 6/1997 | Nakamura | 227/109 |
| 5,695,108 | A * | 12/1997 | Lee | 227/109 |
| 5,791,548 | A * | 8/1998 | Udagawa et al. | 227/131 |
| 5,794,832 | A * | 8/1998 | Chen | 227/109 |
| 5,836,502 | A * | 11/1998 | Kanai et al. | 227/131 |
| 5,846,019 | A * | 12/1998 | Kuhns | 403/282 |
| 5,931,364 | A * | 8/1999 | Dennis | 227/109 |
| 6,050,471 | A * | 4/2000 | Yagi | 227/119 |
| 6,345,754 | B1 * | 2/2002 | Jeng | 227/109 |
| 6,360,933 | B1 * | 3/2002 | Richardot et al. | 227/109 |
| 6,481,703 | B2 * | 11/2002 | Yoshida et al. | 270/58.08 |
| 6,547,230 | B2 * | 4/2003 | Sato | 270/58.08 |
| 6,550,757 | B2 * | 4/2003 | Sesek | 270/58.09 |
| 6,595,509 | B2 * | 7/2003 | Sesek | 270/58.09 |
| 6,634,536 | B2 | 10/2003 | Yoshie | |
| 6,681,975 | B2 * | 1/2004 | Yamaguchi | 227/82 |
| 7,017,789 | B2 * | 3/2006 | Mochizuki et al. | 227/119 |

FOREIGN PATENT DOCUMENTS

| | | | |
|---|---|---|---|
| JP | 60-012706 | U | 1/1985 |
| JP | 60-117073 | U | 8/1985 |
| JP | 02-104983 | U | 8/1990 |
| JP | 04-097668 | U | 8/1992 |
| JP | 2001-179654 | | 7/2001 |
| JP | 2005-193316 | | 7/2005 |

* cited by examiner

STAPLER AND STAPLE

BACKGROUND OF THE INVENTION

1. Field of the Invention

The present invention relates to a stapler and staples which are used to bind a binding object.

2. Description of the Related Art

Hitherto, as staples, there are horseshoe staples 201 illustrated in FIG. 15A and sheet type staples 301 which are rectilinearly formed and bent into a horseshoe shape when a binding object is bound as illustrated in FIG. 14. As a binding object, for example, there is a sheet bundle, a corrugated bundle, a plurality of piled cloths, or the like.

Generally, a stapler using the horseshoe staples manually drives the staples to a binding object (Japanese Patent Application Laid-Open No. 2005-193316). As such a kind of stapler, for example, there is such a stapler that the user holds the stapler in his hand and grasps it, thereby binding the binding object. In order to design the stapler in a size at which the user can hold it in his hand, the number of staples which can be enclosed in the stapler is set to about 50 to 100. Since the stapler uses the horseshoe staples, unlike a stapler using sheet type staples, which will be described hereinafter, it is unnecessary to bend the sheet type staples into a horseshoe shape and, thereafter, bind the binding object, and even a person having a weak grip can easily bind the binding object.

According to the stapler using the sheet type staples, since the sheet type staples are bent into the horseshoe shape and, thereafter, the binding object is bound, a load which is necessary upon binding is larger than that of the stapler using the horseshoe staples and most of the staplers using the sheet type staples are electric staplers (Japanese Patent Application Laid-Open No. 2001-179654). As illustrated in FIG. 14, before the sheet type staples are used, the sheet type staples are connected, formed in a sheet shape, overlaid and enclosed, or wound in a roll shape and enclosed. Therefore, as a stapler using the sheet type staples, there is a stapler in which at least 5000 staples can be enclosed.

SUMMARY OF THE INVENTION

However, according to the stapler using the horseshoe staples in the related art, the horseshoe staples constructed in a block shape are enclosed and each time one staple is used, one staple is fed by a spring. Therefore, in the stapler using the horseshoe staples in the related art, when a block length of the block-shaped horseshoe staples becomes short, the stapler enters a state where the spring is extended, a feeding force adapted to feed the horseshoe staples is weakened, and there is a risk that the horseshoe staples cannot be certainly fed.

Also in the stapler which use staples widened toward the ends and which has been developed by the same applicant, in a manner similar to the stapler using the horseshoe staples in the related art, if the staples are fed by the spring, when the spring is extended long, a feeding force adapted to feed the staples widened toward the ends is weakened, and there is a risk that the staples cannot be certainly fed.

Therefore, according to the stapler in the related art, when the block length of the staples becomes short, the staples are slanted, there is a case where a staple choke occurs, and a binding efficiency of the binding object is low.

It is an object of the invention to provide a stapler for binding a binding object by a staple having a pressing portion for pressing the binding object and a pair of inserting portions which are extended from the pressing portion and are bent and insert the binding object, wherein the staples can be certainly fed. It is another object of the invention to provide a stapler in which a load at the time of driving the staple is small and a number of staples can be enclosed by a simple structure.

When the horseshoe staples are formed in a block shape (FIGS. 15A and 15B) and, for example, enclosed in a box, if they are overlaid and enclosed, a wide enclosing space is necessary and the box enlarges. Therefore, as illustrated in FIG. 15B, in many cases, the horseshoe staples 201 are enclosed in a state where opening portions of the horseshoe shapes confront each other and front edges of the staples are mutually inserted in a slightly deviated manner. However, the horseshoe staples 201 need a space A when they are inserted, and a wide enclosing space is necessary.

As mentioned above, although the stapler using the horseshoe staples has such an advantage that even a person having a weak grip can easily bind the binding object, there is such a problem that an enclosing space is necessary and when the staples are enclosed in a limited space, the number of enclosing staples is small.

Although the stapler using the sheet type staples 301 has such an advantage that a number of staples can be enclosed, there is such a problem that since it is often an electric type, a structure is complicated.

It is, therefore, an object of the invention to provide staples which can be driven to a sheet bundle by a small load without needing a wide enclosing space.

According to the invention, there is provided a stapler comprising: an enclosing unit which encloses a plurality of staples each of which has a pressing portion for pressing a binding object and a pair of inserting portions that are extended from the pressing portion and are bent and insert the binding object and which are connected so that they can be separated; a clinch unit which bends the inserting portions; a projecting unit which projects the staple from the enclosing unit, allows the inserting portions to insert the binding object, bends the inserting portions in cooperation with the clinch unit, and binds the binding object; and a feeding unit which feeds the staples to a position where the staple is projected by the projecting unit while coming into contact with the pressing portion and the pair of inserting portions of the staple.

According to the invention, since the feeding unit comes into contact with the pressing portion and the pair of inserting portions of the staple and feeds the staple, the staple is hardly slanted, the staple can be certainly fed, and a binding efficiency of the binding object can be improved.

According to the invention, since the feeding unit is come into contact with the pressing portion and the pair of inserting portions of the staple and feeds the staple, the staple is hardly slanted, the staple can be certainly fed, and a binding efficiency of the binding object can be improved.

According to the invention, there is provided a stapler comprising: an enclosing unit which encloses staples; a clinch unit which bends the staple; a projecting unit which projects the staples from the enclosing unit, allows the staple to insert the binding object, bends the staple in cooperation with the clinch unit, and binds the binding object; and a guide unit which has guide surfaces for guiding the staple from an inlet adapted to receive front edges of the staple to an outlet that is formed narrower than the inlet and through that the staple is pressed by the projecting unit and slips out toward the binding object side and which guides the staple projected from the enclosing unit by the projecting unit to the binding object.

According to the invention, the guide surfaces for guiding the staple are provided between the inlet to the outlet of the guide unit, and the staples which have previously been bent so as to be widened toward the ends can be used.

Therefore, a load at the time of driving the stale is smaller than that of the stapler for bending the sheet type staples in a horseshoe shape and, thereafter, binding the binding object by an amount corresponding to the portion of the staple which has previously been bent, and a structure can be simplified.

According to the invention, there is provided a staple which is separated by a stapler in a state where a plurality of staples have been connected so that they can be separated and which binds a sheet bundle, comprising: a pressing portion for pressing the sheet bundle; and a pair of inserting portions that are extended from the pressing portion and are bent and insert the sheet bundle, wherein before the staple is used, an interval between the inserting portions is widened from the pressing portion toward front edges of the inserting portions.

Since the staples of the invention are formed so as to be widened toward the ends, when the staples are enclosed into a box or the stapler, they can be overlaid and the enclosing efficiency can be improved more than that of the horseshoe staples.

Further features of the present invention will become apparent from the following description of exemplary embodiments with reference to the attached drawings.

DESCRIPTION OF THE EMBODIMENTS

A stapler of an embodiment of the invention will be described hereinbelow with reference to the drawings.

(Staple)

First, staples which are used in a stapler 90 in the embodiment of the invention will be described.

Figure 1A:
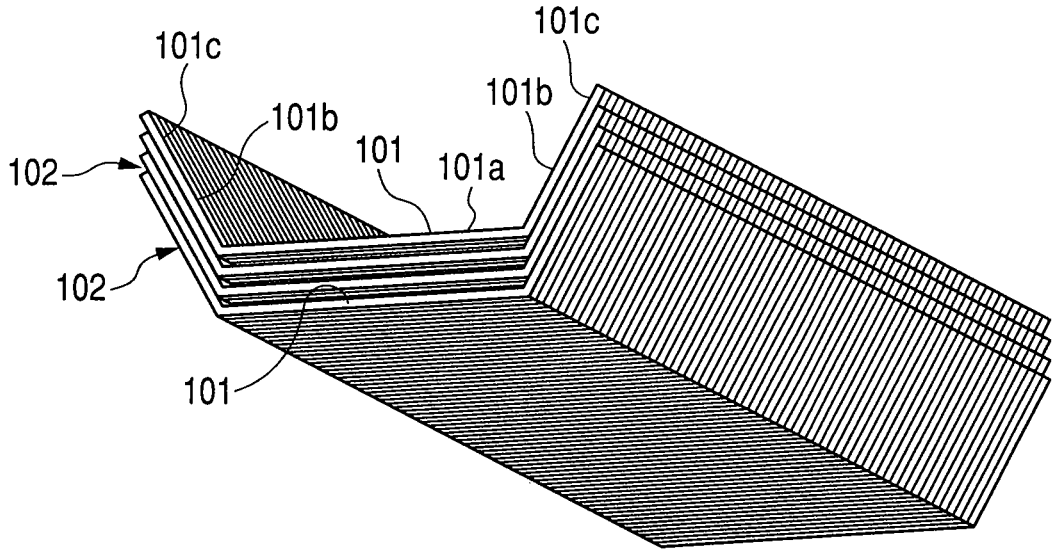
FIG. 1A is a perspective view of staples in a state where the staples which are used in a stapler of the embodiment are connected into a block shape and the blocks are overlaid.
Figure 1B:
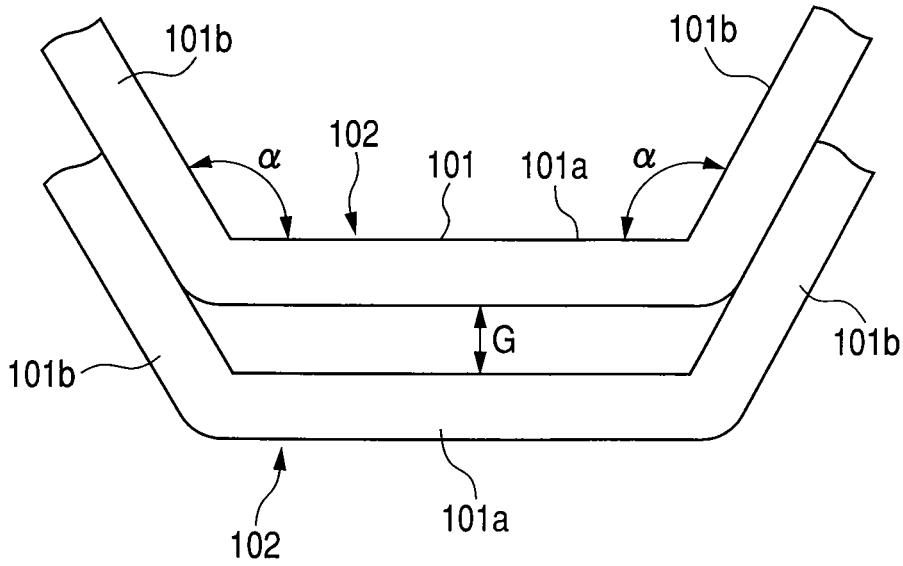
FIG. 1B is a partial enlarged diagram of the staples illustrated in FIG. 1A.
Figure 2A:
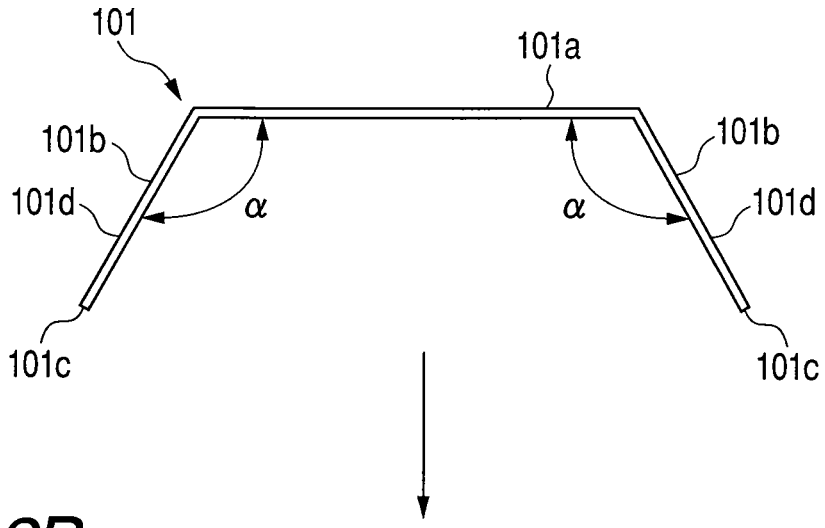
FIGS. 2A, 2B, and 2C are diagrams for describing bending order of the staple at the time of binding a sheet bundle.
Figure 2B:
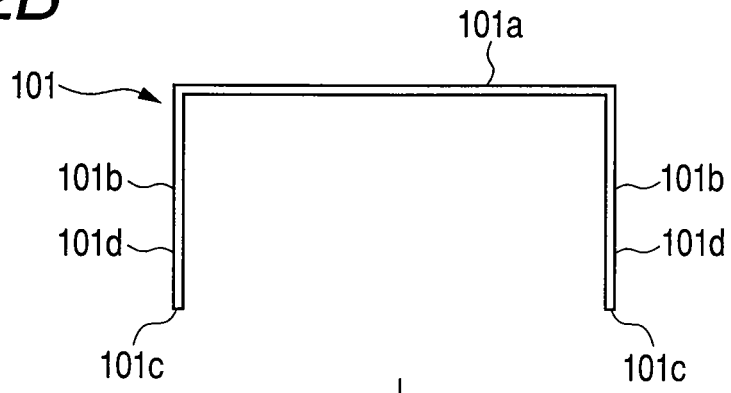
Figure 2C:
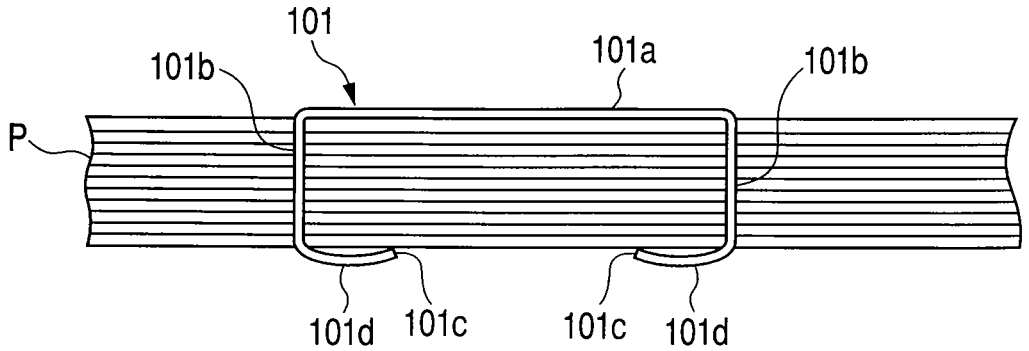

FIGS. 1A and 1B are perspective views of the staples in a state where the staples in the embodiment of the invention have been connected into a block shape and the block-shaped staples are overlaid. FIG. 1A is a whole diagram illustrating a state where the block-shaped staples have been overlaid. FIG. 1B is a partial enlarged diagram illustrating a state where the block-shaped staples have been overlaid. FIGS. 2A, 2B, and 2C are diagrams for describing bending order of the staple at the time of binding a sheet bundle.

A plurality of staples 101 is connected into a block shape so that they can be separated. When the block-shaped staples 101 are set into the stapler and used, they are separated one by one and are bent into a horseshoe shape, thereby binding a sheet bundle.

The staple 101 has: a pressing portion 101*a* for pressing the sheet bundle; and a pair of inserting portions 101*b* which are formed by being extended from both ends of the pressing portion 101*a* and bent and insert the sheet bundle. Before the staples 101 are used, an interval between the inserting portions 101*b* is widened from the pressing portion 101*a* toward front edges 101*c* of the pair of inserting portions 101*b*. Therefore, the staples 101 are formed in a trapezoidal shape before they are used. Bending portions 101*d* of the front edges of the inserting portions 101*b* are bent so as to face each other when they insert the sheet bundle.

When the sheet bundle is bound by the stapler, the staples 101 are separated one by one from a state of the block-shape (FIG. 2A), the inserting portions 101*b* are bent at a right angle for the pressing portion 101*a* (FIG. 2B), and the staple 101 is formed in a horseshoe shape as a whole. After the inserting portions 101*b* inserted the sheet bundle, the staple 101 is bent so that the bending portions 101*d* face each other, thereby preventing a sheet bundle P from being separated. When a thickness of sheet bundle to be bound is thin, there is a case where the whole inserting portions 101*b* substantially become the bending portions 101*d*. Since the inserting portions 101*b* are portions which insert the sheet bundle, they include the front edges 101*c* and the bending portions 101*d*.

As an opening angle α of the staple 101 is closer to a right angle, a load at the time when the stapler bends the staple into a horseshoe shape can be reduced more. However, according to such a staple, when the staples are formed into the block shape and the block-shaped staples are overlaid, a gap G (FIG. 1B) is widened and a large enclosing space is necessary. On the contrary, in the case of the staples 101 whose opening angle α is close to 180°, when the staples are formed into the block shape and the block-shaped staples are overlaid, the gap G is narrowed and the enclosing space can be decreased. However, when such staples are used, a load at the time when the stapler bends the staple into the horseshoe shape increases. A stroke upon bending the staple increases, and the binding operation time of the stapler becomes long, so that the binding efficiency of the stapler deteriorates.

Therefore, experiments in which the sheet bundle is bound by using the staples having various opening angles were executed, so that it has been found that it is desirable to set the opening angle α to a value within a range from 100° to 150° as a point of compromise of the enclosing space of the staples, the load of the stapler, and the binding efficiency.

Figure 13:
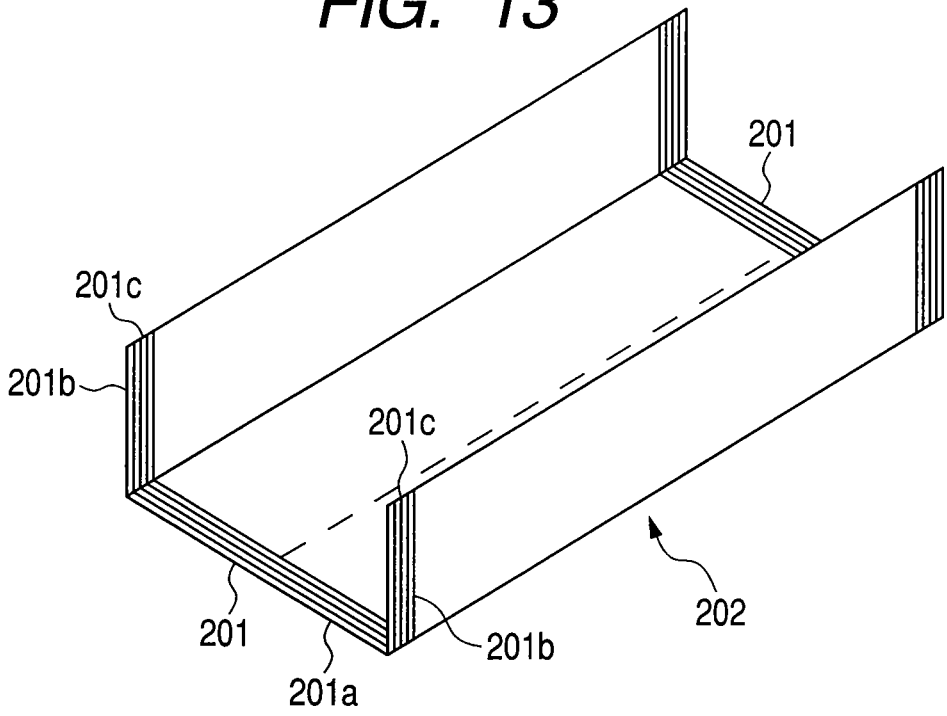
FIG. 13 is a diagram of the horseshoe staples.

Since the staples 101 are formed so as to be widened toward the ends, when they are enclosed into a box or stapler, they can be overlaid as illustrated in FIGS. 1A and 1B. Therefore, an enclosing efficiency of the staples 101 can be improved more than that of the horseshoe staples 201 illustrated in FIG. 13. Since the opening angle of the staple has been set to the value within the range from 100° to 150°, the increase in load at the time when the stapler binds the sheet bundle can be prevented. Thus, the enclosing efficiency of the staples can be improved without deteriorating the binding efficiency.

Figure 14:
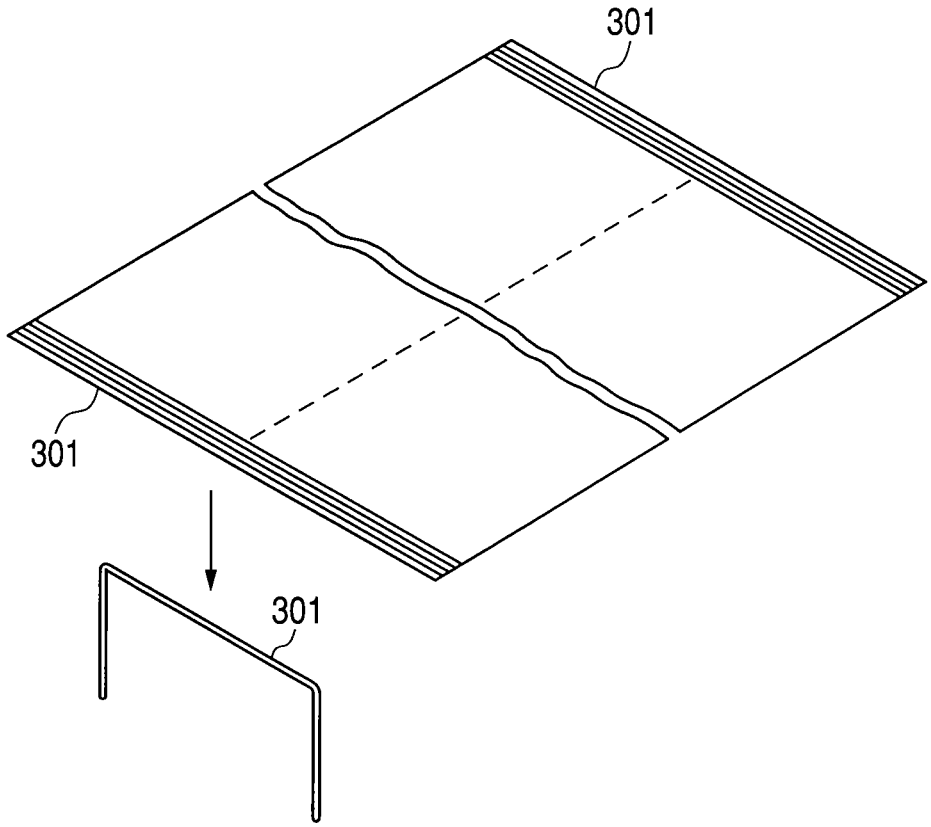
FIG. 14 is a diagram of sheet type staples.
Figure 15A:
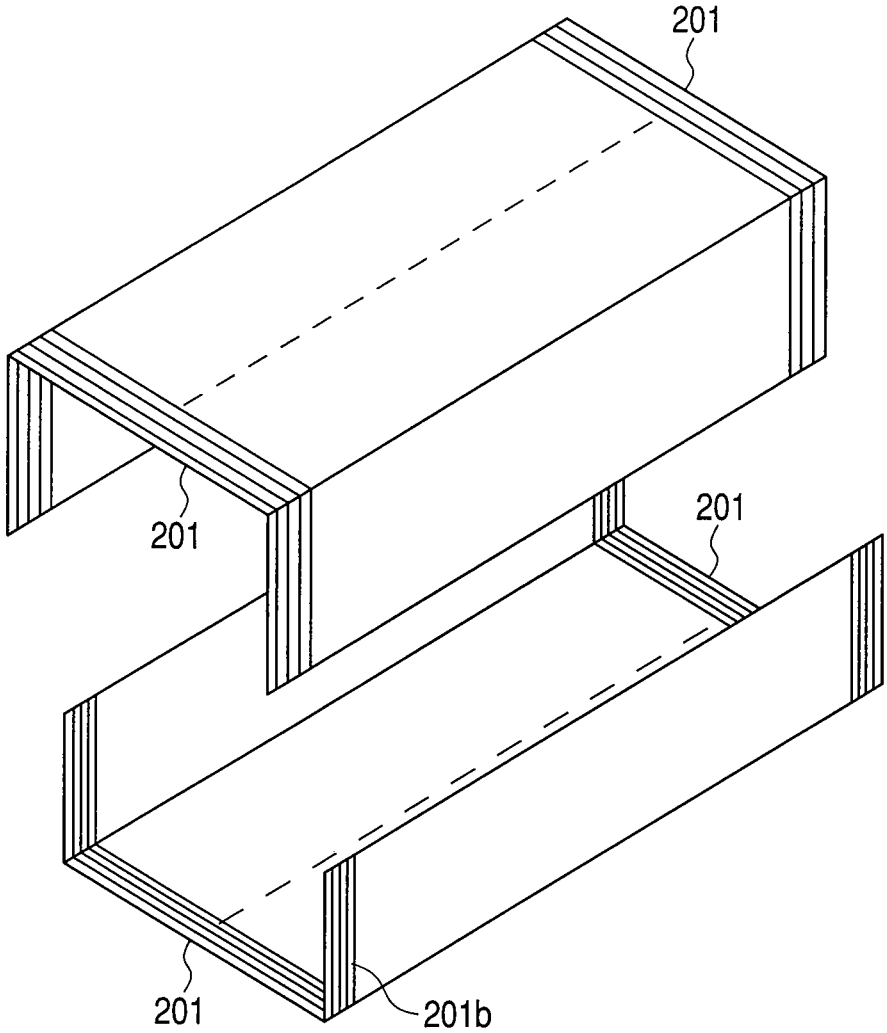
FIGS. 15A and 15B are diagrams of horseshoe staples in a related art.
Figure 15B:
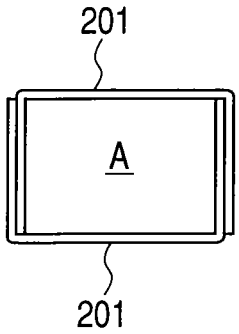

Since the staples 101 are formed so as to be widened toward the ends, they are more difficult to be deformed than the sheet type staples 301 illustrated in FIG. 14. When the staples 101 are set into the stapler, they are hardly choked and the binding operation of the stapler is hardly interfered.

Further, since the staples 101 are more difficult to be deformed than the sheet type staples 301, it is unnecessary to handle the stapler while paying an attention so as not to deform the staples 101, and it is easy to handle.

(Stapler)

Subsequently, the stapler in the embodiment of the invention will be described with reference to FIGS. 3 to 10B.

The staples 101 illustrated in FIGS. 1A, 1B, 2A, 2B, and 2C have been described on the assumption that the sheet bundle is bound. However, according to such staples 101, by changing ratios of lengths of the pressing portion, inserting portions, and bending portions, a thickness of staple, or the like without changing the shapes of the staples widened toward the ends, not only the sheet bundle but also other binding objects such as corrugated bundle, a plurality of overlaid cloths, and the like can be bound. Therefore, the present stapler can bind various binding objects by using the staples according to the kind of binding object to be bound.

(Structure of Stapler)

Figure 4:
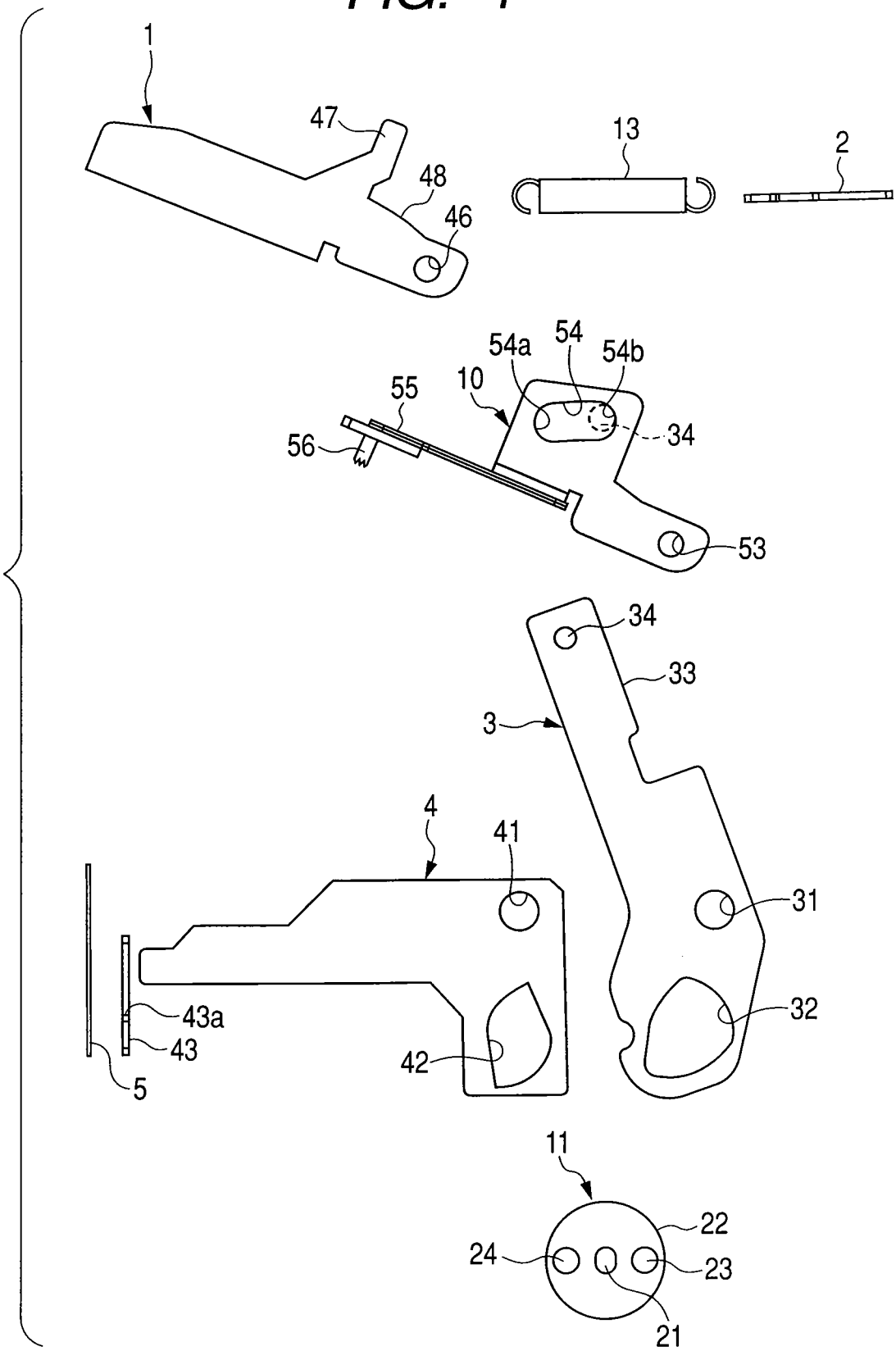
FIG. 4 is a diagram illustrating parts of the stapler of FIG. 3.

A motor 8 is provided for a frame 91 of a stapler 90. The motor 8 rotates a cam 11 through a gear train 12 rotatably arranged to the frame 91. The cam 11 is rotatably supported to the frame 91 by an axis 21. In FIG. 4, a last gear 22 of the gear train 12 is formed on an outer circumference of the cam 11. A driver pin 23 and a pressing pin 24 are projected onto the cam 11 at an interval of 180°.

Figure 3:
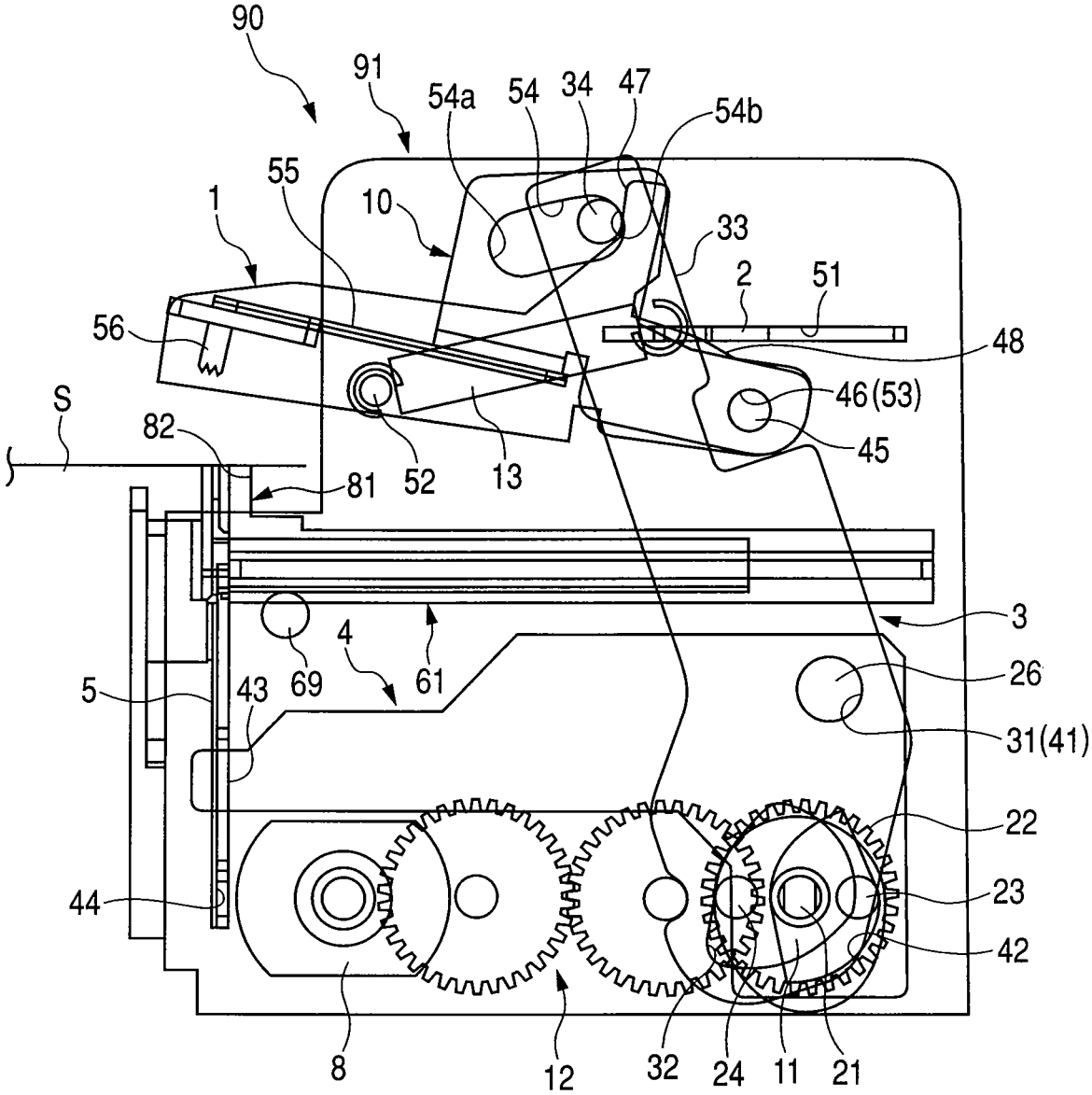
FIG. 3 is a front cross sectional view of the stapler in a standby mode in the embodiment.

In FIGS. 3 and 4, an arm supporting axis 26 is provided for the frame 91. A pressing arm 3 and a driver arm 4 are provided for the arm supporting axis 26 so as to be rotatable in the direction which perpendicularly crosses the arm supporting axis 26.

A supporting hole 31 through which the arm supporting axis 26 inserts and a pressing cam hole 32 with which the pressing pin 24 of the cam 11 comes into engagement are formed in the pressing arm 3. A contact portion 33 with which a pressing locking plate 2, which will be described hereinafter, comes into contact is formed on an outer circumference of the pressing arm 3. A link pin 34 which comes into engagement with a sheet pressing link 1 and a clincher link 10, which will be described hereinafter, are projected onto the pressing arm 3. The pressing cam hole 32 and the link pin 34 are formed on both sides of the supporting hole 31.

A supporting hole 41 through which the arm supporting axis 26 inserts and a driver cam hole 42 with which the driver pin 23 of the cam 11 is come into engagement are formed in the driver arm 4. A hole 43a of a driver supporting plate 43 is in engagement with a rotational end portion of the driver arm 4 so that it can be freely inclined. A driver 5 is provided for the driver supporting plate 43. The driver supporting plate 43 is inserted into a vertical slit 44 formed in the frame 91. The driver supporting plate 43 is rectilinearly elevated up and down integratedly with the driver 5 by the rotation of the driver arm 4 and the guide of the vertical slit 44.

A link axis 45 is provided for the frame 91 of the stapler 90. The sheet pressing link 1 and the clincher link 10 are provided for the link axis 45 so as to be rotatable in the direction which perpendicularly crosses the link axis 45.

A supporting hole 46 through which the link axis 45 inserts and a pin contact portion 47 with which the link pin 34 comes into contact are formed in the sheet pressing link 1. A tapered portion 48 on which the pressing locking plate 2 slides is formed on an outer circumference of the sheet pressing link 1.

An almost horizontal lateral slit 51 (FIG. 3) is formed onto the frame 91 of the stapler 90. The pressing locking plate 2 is slidably provided for the lateral slit 51. A pin 52 (FIG. 3) is projected onto the frame 91 of the stapler 90. A tension spring 13 is suspended between the pin 52 and the pressing locking plate 2.

A supporting hole 53 through which the link axis 45 inserts and an arc-shaped long hole 54 through which the link pin 34 on the pressing arm 3 are formed in the clincher link 10. A plurality of plate springs 55 is overlaid and provided at a rotational end of the clincher link 10. A clincher 56 is provided at a front edge of the plate springs 55. For example, the clincher 56 serving as a clinch portion bends the bending portions 101*d* of the staple 101 (FIGS. 2A, 2B, and 2C) in cooperation with, for example, the driver 5 serving as a projecting unit.

A staple supplying portion 61 is provided for the frame 91 of the stapler 90.

Figure 5B:
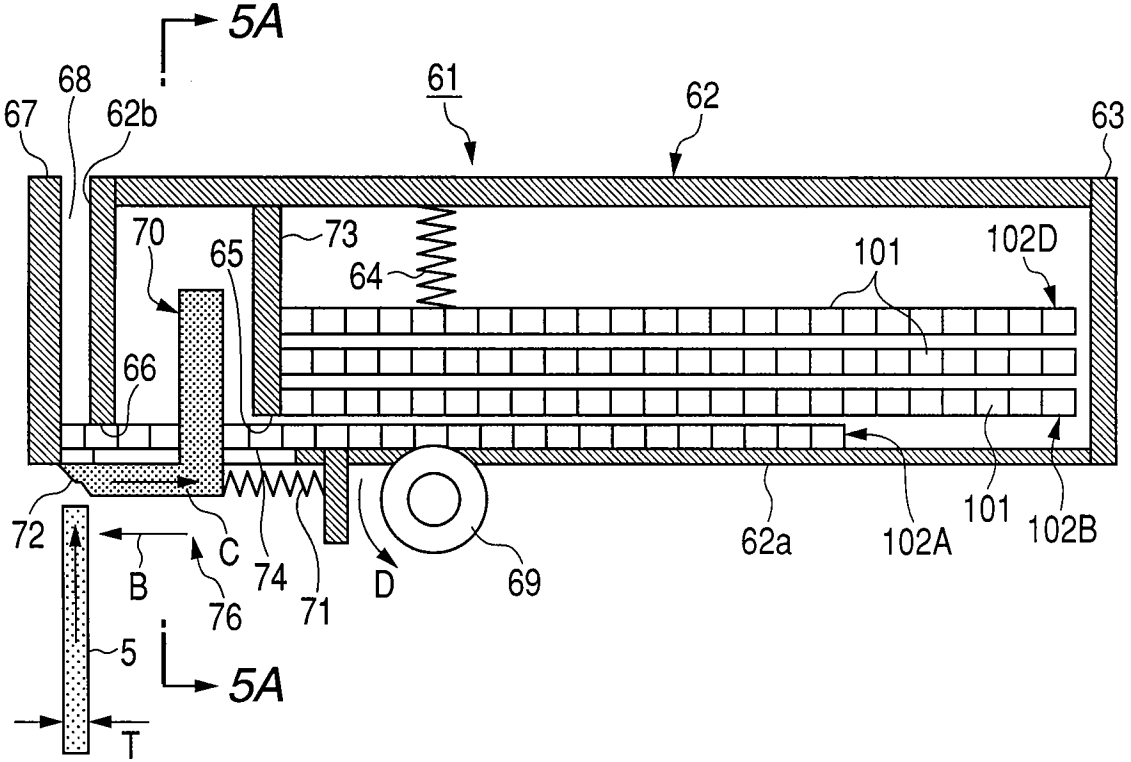
FIG. 5B is a cross sectional view of the staple supplying portion in FIG. 5A taken along the staple feeding direction.
Figure 5A:
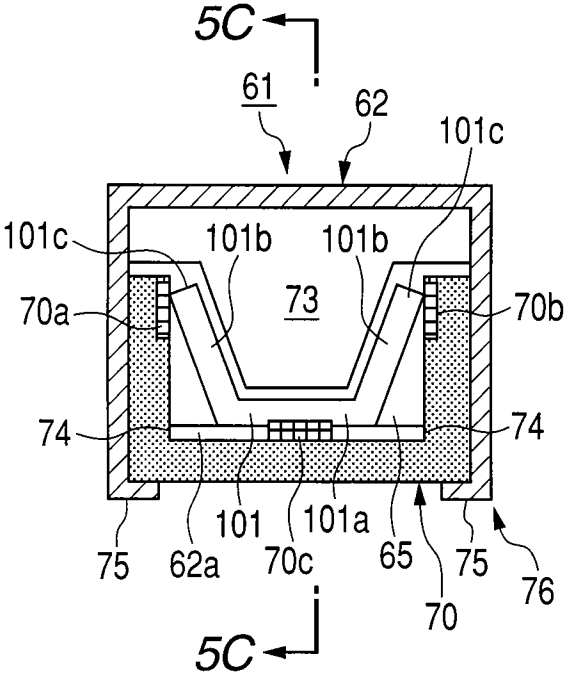
FIG. 5A is a cross sectional view of a staple supplying portion provided for the stapler in FIG. 3 in the direction which crosses the staple feeding direction and is a cross sectional view taken along the line 5A-5A in FIG. 5B.
Figure 5C:
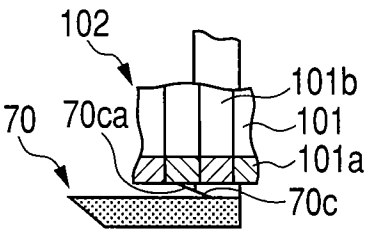
FIG. 5C is a cross sectional view of the staple supplying portion in FIG. 5A taken along the line 5C-5C.

The block-shaped staples 101 whose front edges 101*c* face upward as illustrated in FIGS. 1A and 1B have been enclosed in an overlaid state in the staple holder 62 serving as an enclosing portion of the staple supplying portion 61 illustrated in FIGS. 5A, 5B, and 5C. That is, the staple holder 62 can enclose the staples 101 in an overlaid block shape. In the following description, when a number of staples 101 are connected in a block shape in a state where they can be separated, such staples are called block staples. The block staples are generally represented by a reference numeral 102.

A cover 63 of the staple holder 62 is opened and the block staples 102 are inserted and enclosed into the staple holder 62. A plurality of block staples 102 overlaid and enclosed in the staple holder 62 are always pressed toward a bottom portion 62*a* by a compression spring 64. Therefore, just before a bottom block staples 102A are used and extinguished, the next upper block staples 102 are closely adhered to the bottom portion 62*a* of the staple holder 62.

A restricting plate 73, which will be described hereinafter, is provided on the side of the staple holder 62 opposite to the cover 63. Further, a passing portion 65 through which the staples 101 pass and an ejecting portion 66 from which the staples 101 are ejected are formed. A catching plate 67 for catching the staples 101 is provided. Each of the passing portion 65 and the ejecting portion 66 is a gap formed in almost the same shape as that of the staples 101 when FIG. 5B is seen from the left side. A guide gap 68 adapted to allow one staple 101 to pass is formed between the catching plate 67 and a front edge wall 62*b* of the staple holder 62. The guide gap 68 is a position where the staple is driven.

A staple feed roller 69 for feeding the bottom block staples 102A to the catching plate 67 side is provided for the bottom portion 62*a* of the staple holder 62. When the staple feed roller 69 serving as a moving unit feeds the bottom block staples 102A to the catching plate 67 side, there is a risk that the next upper block staples of the bottom block staples 102A are moved so as to trace the bottom block staples 102A. Therefore, the restricting plate 73 catches the upper block staples 102 and restricts the tracing movement of the upper block staples.

Further, a slit 74 to guide a feeding member 70 for feeding the staples so that the feeding member 70 can be freely reciprocatively moved in the staple feeding direction (direction shown by an arrow B) and its opposite direction (direction shown by an arrow C) is formed in the bottom portion 62*a*. Thus, the feeding member 70 can move so as to approach and be away from the guide gap 68 as a position where the staple 101 is driven.

The feeding member 70 is formed in almost a U-character shape as illustrated in FIG. 5A when it is seen from the feeding direction side of the staples. The feeding member 70 is formed in an inverse L-character shape as illustrated in FIG. 5B when it is seen from the side along a feeding direction B of the staples. The feeding member 70 has a pull-out preventing projected portion 75 for preventing the staples from being slipped down from the slit 74.

For example, feeding claw 70*a*, 70*b*, and 70*c* serving as engaging members are provided at three positions of the portion of the feeding member 70 which comes into contact with the block staples 102. Those three positions are positions which face the pressing portion 101*a* and the pair of inserting portions 101*b* of the staple 101. As illustrated in FIG. 5C, the feeding claw 70*c* is provided in a cantilever manner for the feeding member 70 serving as a moving member. The feeding claw 70*c* is an elastic member and a front edge portion 70*ca* is extended to the position (guide gap 68) side where the staple 101 is driven, and can come into engagement with and can be removed away from the pressing portion 101*a* of the staple 101. The other feeding claws 70*a* and 70*b* also have a shape similar to that of the feeding claw 70*c*, are similarly attached to the feeding member 70, and come into engagement with the front edges 101*c* of the pair of inserting portions 101*b*.

When the feeding member 70 moves in the staple feeding direction B, a front edge portion of each of the feeding claws 70*a*, 70*b*, and 70*c* comes into engagement with a gap between the staples, thereby feeding the staples. When the feeding member 70 moves in the reverse direction C, the front edge portion of each of feeding claws 70*a*, 70*b*, and 70*c* is returned without coming into engagement with the gap between the staples. Therefore, the feeding claws 70*a*, 70*b*, and 70*c* are the elastic members which are inclined in pressure contact with the block staples 102.

The feeding claws 70*a* and 70*b* come into engagement with the pair of front edges 101*c* (inserting portions 101*b*) of the staple from both sides. The feeding claw 70*c* comes into engagement with the pressing portion 101*a* of the staple. As mentioned above, since the claws of the feeding member are in engagement with the bilaterally symmetrical three portions of the staple when the staple is seen from the direction illustrated in FIG. 5A, the feeding member can apply a bilaterally equivalent feeding force to the staple and smoothly feed the staple. Thus, the stapler 90 hardly executes the operation for binding the sheet bundle in a state where no staple is projected (idle driving operation) and hardly fails in binding of the sheet bundle. Particularly, even if a length of last block staples 102D becomes short and the staple is liable to turn sideways in the staple holder 62 or is liable to be inclined in the feeding direction, such a phenomenon that the staple turns sideways or is inclined is restricted and the staple can be smoothly fed. Although the feeding member 70 comes into engagement with the three positions of the staple, it may come into engagement therewith at four or more positions. However, also in such a case, when the staple is seen from the direction illustrated in FIG. 5A, it is desirable that the feeding claws are in engagement with the staple at the bilaterally symmetrical positions.

The feeding member 70 is urged in the feeding direction B of the staples by a feeding spring 71 and caught by the catching plate 67. A tapered portion 72 is provided for the feeding member 70 on the side of the catching plate 67. The tapered portion 72 functions so as to press and return the feeding member 70 in the direction shown by an arrow C against the feeding spring 71 by a component force which is generated when the tapered portion 72 is pressed by the plate-shaped driver 5 which ascends from the lower direction. Each of the feeding claws 70*a*, 70*b*, and 70*c* of the pressed and returned feeding member 70 comes into engagement with the gap between the staples 101. Even if the feeding member 70 is pressed by the feeding spring 71, the movement toward the catching plate 67 side is restricted. A thickness T of driver 5 is set to a value adapted to push only one staple upward. Therefore, the feeding member 70 is pressed and returned by an amount corresponding to the thickness of one staple. That is, the feeding member 70 is reciprocatively moved by an amount corresponding to the thickness of one staple.

The feeding member 70, feeding claws 70*a*, 70*b*, and 70*c*, feeding spring 71, driver 5, and the like construct, for example, a feeding portion 76 serving as a feeding unit.

A guide portion 81 (FIG. 3 and FIGS. 9A to 9D) for deforming the staples widened toward the ends into the horseshoe shape is provided over the guide gap 68 (FIG. 5B) of the staple holder 62. The guide portion 81 has guide surfaces 81*c* for guiding the staple 101. The guide surfaces 81*c* are formed narrower than an inlet 81*a* from the inlet 81*a* adapted to receive the front edges 101*c* of the staple 101 toward an outlet 81*b* from which the staple 101 is pressed by the driver 5 and slips out toward the binding object side.

A clinch base plate 82 on which the binding object is put is provided on the guide portion 81.

According to the stapler 90 in the embodiment, the staple supplying portion 61, driver 5, guide portion 81, sheet pressing link 1, clincher 56, and the like can be exchanged according to a staple size.

(Operation of Stapler)

The staples have been enclosed in the staple holder 62 of the stapler 90 in the state illustrated in FIG. 1A. In FIG. 5B, the bottom block staples 102A are pressed to the catching plate 67 by the counterclockwise D rotation of the staple feed roller 69. As illustrated in FIG. 3, the sheet pressing link 1 and the clincher 56 are away from the clinch base plate 82. Further, the driver 5 is located at the bottom descended position.

When a binding object S is put onto the clinch base plate 82 of the stapler 90 in the standby mode illustrated in FIG. 3 and the motor 8 is activated, the cam 11 rotates.

Figure 6:
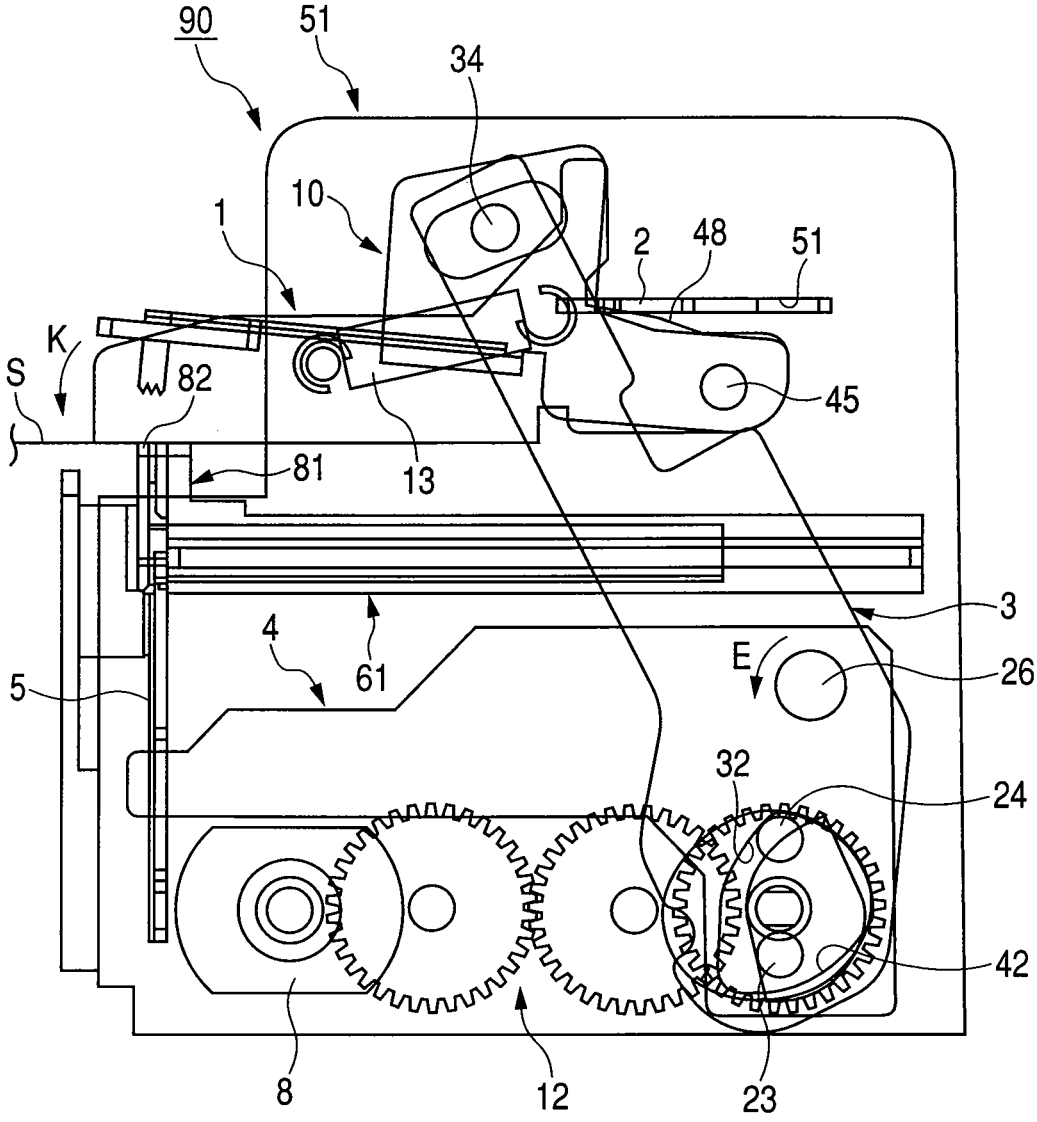
FIG. 6 is a diagram for describing the operation of the stapler in FIG. 3 and is a diagram illustrating a state where a binding object has been pressed onto a clinch base plate by a sheet pressing link from the state of FIG. 3.

As illustrated in FIG. 6, the cam 11 presses the pressing pin 24 while rotating, thereby rotating the pressing arm 3 counterclockwise (direction shown by an arrow E) around the arm supporting axis 26 as a rotational center. The pressing locking plate 2 which has been pulled by the tension spring 13 and has been in contact with the pressing arm 3 is moved so as to trace the rotation of the pressing arm 3. The pressing arm 3 presses the tapered portion 48 of the sheet pressing link 1. Thus, the sheet pressing link 1 rotates counterclockwise (direction shown by an arrow K) around the link axis 45 as a rotational center and presses the binding object S to the clinch base plate 82.

Figure 7:
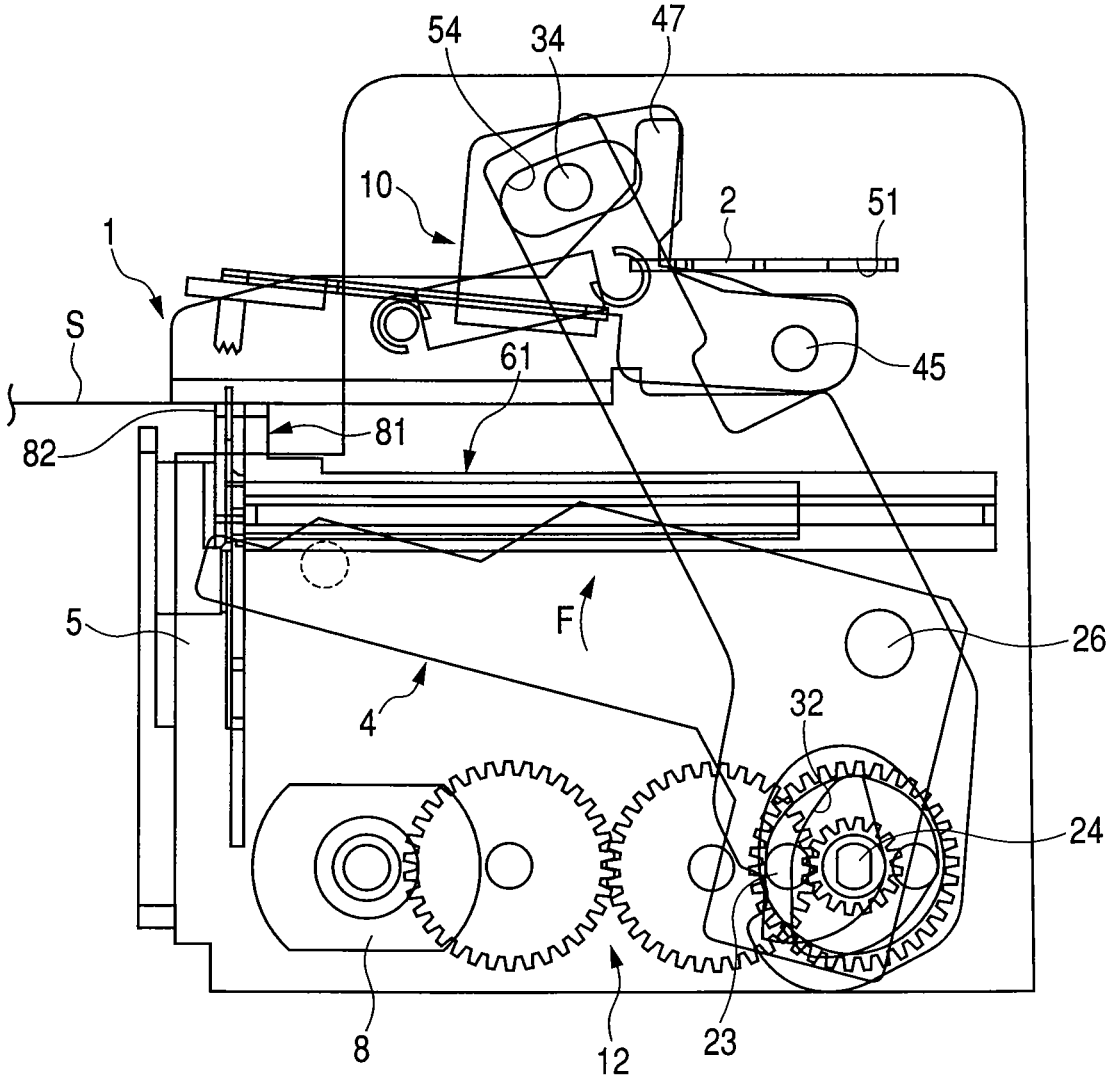
FIG. 7 is a diagram for describing the operation of the stapler in FIG. 3 and is a diagram illustrating a state where the staple has been inserted through the binding object from the state of FIG. 6.
Figure 9A:
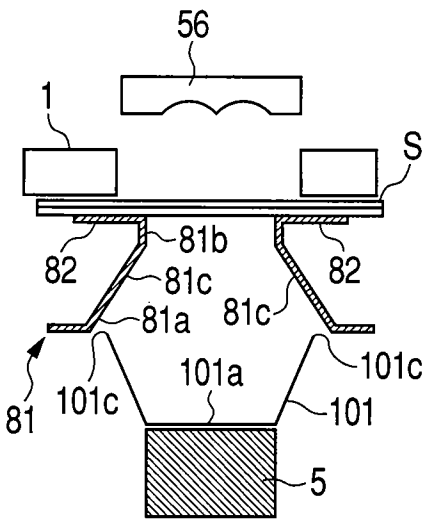
FIG. 9A is a diagram for describing the operation for bending the staple into a horseshoe shape in the stapler in FIG. 3 and is a diagram illustrating a state where the staple has been elevated by a driver.
Figure 9B:
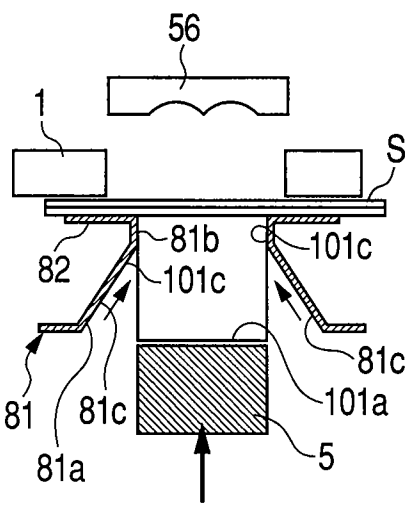
FIG. 9B is a diagram for describing the operation for bending the staple into the horseshoe shape in the stapler in FIG. 3 and is a diagram illustrating a state where the staple has been deformed into the horseshoe shape by a guide portion.
Figure 9C:
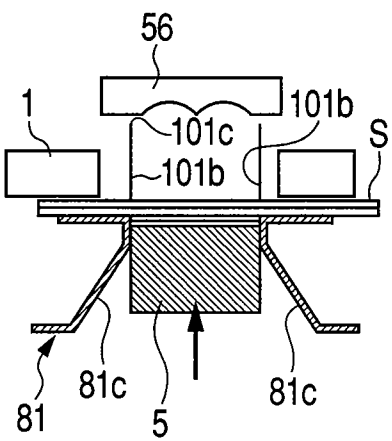
FIG. 9C is a diagram for describing the operation for bending the staple into the horseshoe shape in the stapler in FIG. 3 and is a diagram illustrating a state where the staple has been-inserted to the binding object.

The cam 11 also presses the driver cam hole 42 by the driver pin 23 while rotating as mentioned above. As illustrated in FIG. 7, the cam 11 rotates the driver arm 4 clockwise (direction shown by an arrow F) around the arm supporting axis 26 as a rotational center, thereby elevating the driver 5 upward. In FIGS. 5A to 5C and 9A to 9D, the driver 5 elevates the guide gap 68 by an amount corresponding to only one staple 101. As illustrated in FIGS. 9A to 9C, the pressing portion 101*a* of the staple 101 is pressed by the driver 5 and the staple 101 is elevated upward, passes through the guide gap 68, and enters the inlet 81*a* of the guide portion 81 (FIG. 9A).

While the front edges 101*c* are in contact with the guide surfaces 81*c*, the staple 101 further ascends (FIG. 9B) and is bent and deformed into the horseshoe shape from the shape widened toward the end. The front edges 101*c* of the staple slip out of the outlet 81*b*. The inserting portions 101*b* of the staple insert the binding object S with which the outlet 81*b* has been covered (FIG. 9C). Since the binding object S has been pressed to the clinch base plate 82 by the sheet pressing link 1, when the staple 101 inserts, it is not floated up. The driver 5 comes into contact with the pressing portion 101*a* of the staple until the staple 101 which has inserted the binding object S is bent in cooperation with the clincher 56, and holds the state illustrated in FIG. 9C.

Figure 8:
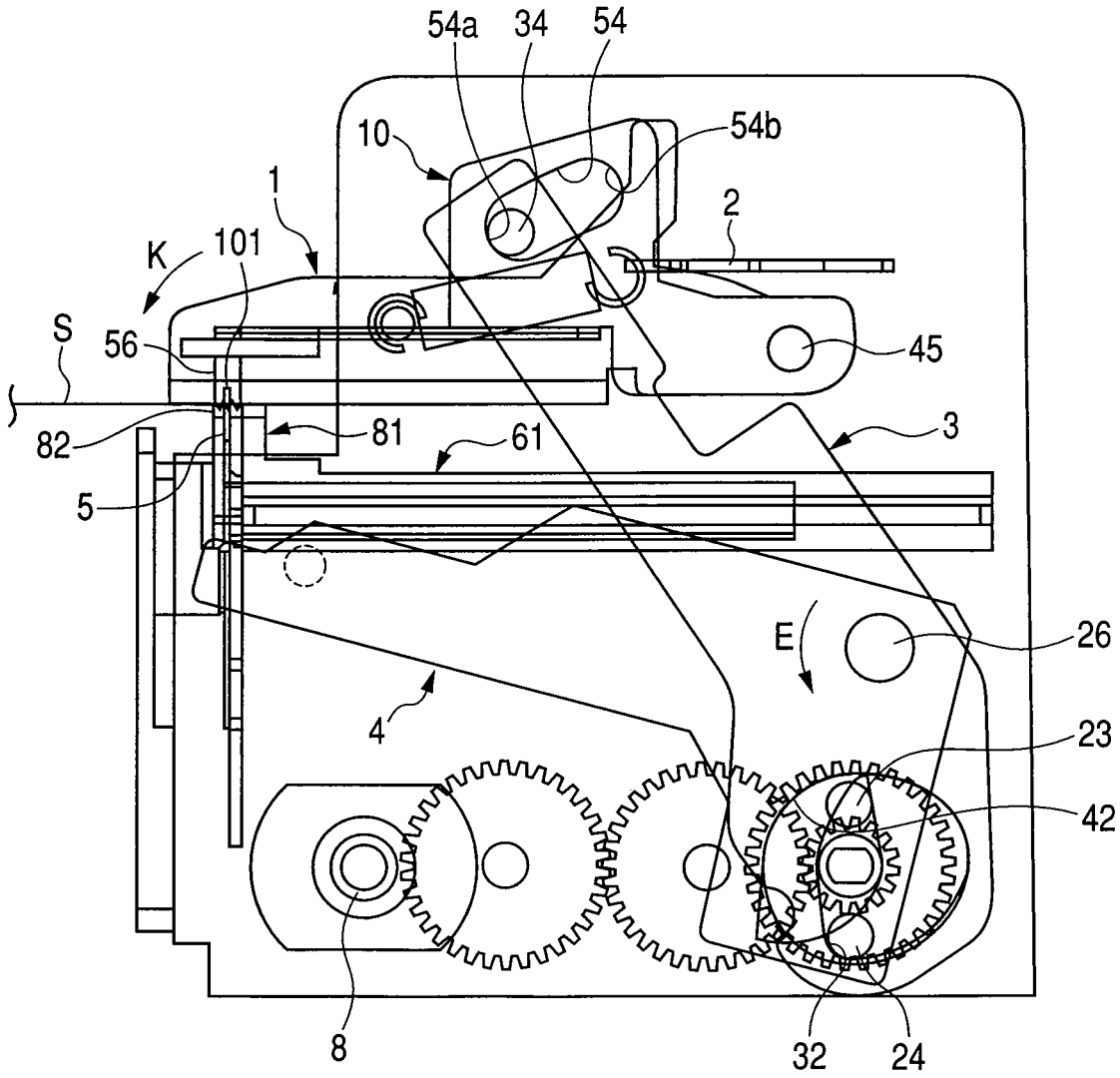
FIG. 8 is a diagram for describing the operation of the stapler in FIG. 3 and is a diagram illustrating a state where the binding object has been bound by the staple from the state of FIG. 7.

The cam 11 continues the rotation. Even after the binding object S was pressed the clinch base plate 82 by the sheet pressing link 1 and the staple was inserted through the binding object by the driver 5, as illustrated in FIG. 8, the cam 11 continues the counterclockwise (direction shown by the arrow E) rotation of the pressing arm 3. The pressing arm 3 presses one end 54*a* of the long hole 54 of the clincher link 10 by the link pin 34, thereby rotating the clincher link 10 counterclockwise (direction shown by the arrow K).

Figure 9D:
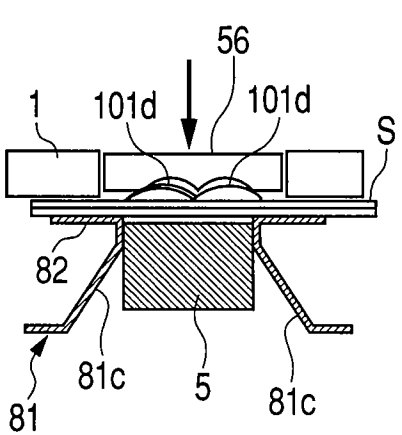
FIG. 9D is a diagram for describing the operation for bending the staple into the horseshoe shape in the stapler in FIG. 3 and is a diagram illustrating a state where the staple has been bent and the binding object has been bound.

In association with the rotation of the clincher link 10, the clincher 56 approaches the binding object S as illustrated in FIGS. 8, 9C, and 9D. The clincher 56 sandwiches (clinches) the staple 101 which has inserted the binding object S and the binding object S together with the driver 5 and bends the bending portions 101*d* of the staple 101. Thus, the binding object S is bound by the staple 101. The staple 101 is come into contact with the obverse and reverse sides of the binding object S by the pressing portion 101*a* and the bending portions 101*d* and holds the binding object S lest the binding object S is separated. When the thickness of binding object S is thin, there is a case where the whole inserting portions 101*b* of the staple 101 substantially become the bending portions 101*d*.

The cam 11 further continues the rotation and rotates the pressing arm 3 clockwise, thereby returning the pressing arm 3 to its initial position. While the pressing arm 3 is returned to the initial position, the pin contact portion 47 of the sheet pressing link 1 is pressed by the link pin 34, thereby rotating the sheet pressing link 1 clockwise so as to be away from the binding object S. The link pin 34 also presses the other end 54*b* of the long hole 54 of the clincher link 10. Therefore, the clincher link 10 is also rotated clockwise and the clincher 56 is also removed away from the binding object S.

In association with the further rotation of the cam 11, the driver arm 4 rotates counterclockwise and pulls out the driver 5 downward from the guide gap 68 of the staple supplying portion 61 (FIG. 5B). Thus, the driver 5 is returned to the initial position.

As illustrated in FIG. 5B, when the driver 5 is pulled out of the guide gap 68, the staple feed roller 69 rotates in the direction shown by the arrow D. The staple feed roller 69 moves the bottom block staples 102A in the feeding direction B so as to be come into contact with the catching plate 67. Thus, the block staples are moved by the amount corresponding to only one staple.

Therefore, the stapler 90 is returned to the initial state and prepares for the next binding operation.

In FIG. 5B, when one staple is driven, the driver 5 presses the tapered portion 72 of the feeding member 70 and elevates it upward. At this time, the tapered portion 72 is pressed by the driver 5 and the feeding member 70 is moved against the feeding spring 71 in such a direction (direction shown by the arrow C) as to be removed away from the catching plate 67. At the same time, each of the feeding claws 70*a*, 70*b*, and 70*c* of the feeding member 70 is removed from the gap between the staples with which each feeding claw has been in engagement so far. Each of the feeding claws 70*a*, 70*b*, and 70*c* comes into engagement with the gap between the next staples in the direction away from the catching plate 67.

After that, when the driver 5 descends, the feeding member 70 is pressed by the feeding spring 71, is moved so as to approach the catching plate 67, and is caught. At this time, the feeding member 70 is moved so as to approach the catching plate 67 while each of the feeding claws 70*a*, 70*b*, and 70*c* is in engagement with the gap between the staples. Therefore, the bottom block staples 102A are moved toward the catching plate 67 side by the amount corresponding to only one staple, thereby allowing the front staple to be come into contact with the catching plate 67. In this instance, the roller 69 also rotates, thereby moving the bottom block staples 102A to the catching side.

When the number of staples 101 of the bottom block staples 102A decreases and the length of block staples becomes shorter than the length between the catching plate 67 and the restricting plate 73, all of the block staples 102 overlaid on the bottom block staples 102A are pressed by the compression spring 64 and drop. Block staples 102B at the second stage from the bottom are caught and stopped by the bottom portion 62*a* and newly become the bottom block staples. When the last block staples 102D have dropped onto the bottom portion 62*a* and the number of staples decreases, since the block staples 102D cannot be fed by the feed roller 69, they are fed only by the feeding member 70. In this manner, the staple supplying portion 61 can efficiently and sequentially supply the staples which have been overlaid and enclosed.

The feeding claw 70*c* may be come into engagement with the pressing portion 101*a* at a plurality of positions. The feeding claws 70*a* and 70*b* may be come into engagement with intermediate portions of the inserting portions 101*b*. The feeding claws 70*a* and 70*b* can be also come into engagement with the inserting portions 101*b* at a plurality of positions.

As described above, according to the stapler 90, the feeding claws 70*a*, 70*b*, and 70*c* of the feeding member 70 are come into engagement with the pressing portion 101*a* of the staple 101 and the front edges 101*c* of the pair of inserting portions 101*b*, thereby feeding the staple 101. Therefore, even if the length of block staples 102 becomes short, the feeding portion 76 inclines the staple 101 so that it is hardly choked into the staple holder 62, and can certainly feed the staple 101. Consequently, the stapler 90 can improve the binding efficiency of the binding object.

As described above, according to the stapler 90, the guide surfaces 81*c* for guiding the staples are provided between the inlet 81*a* and the outlet 81*b* of the guide portion 81 of the staple supplying portion 61 (FIGS. 5A to 5C) and the staples 101 which have previously been bent into the shape widened toward the ends can be used.

Therefore, according to the stapler of the invention, as compared with the stapler which bends the sheet type staples into the horseshoe shape and subsequently binds the binding object, the load at the time of driving the staple is smaller by the amount corresponding to the previously-bent portion of the staple and the structure can be simplified.

According to the stapler of the invention, since the staples which have been bent into the shape widened toward the ends and can be overlaid and enclosed are used, a larger number of staples can be enclosed and the number of supplementing times of the staples can be reduced as compared with the stapler using the horseshoe staples.

Further, according to the stapler of the invention, the feeding claws 70*a* and 70*b* of the feeding member are come into engagement with the pair of front edges 101*c* (inserting portions 101*b*) of the staple from both sides and the feeding claw 70*c* is come into engagement with the pressing portion 101*a* of the staple, thereby feeding the staple. Therefore, the stapler can smoothly feed the staples, hardly executes the idle driving operation, and hardly fails in binding of the sheet bundle.

Figure 10B:
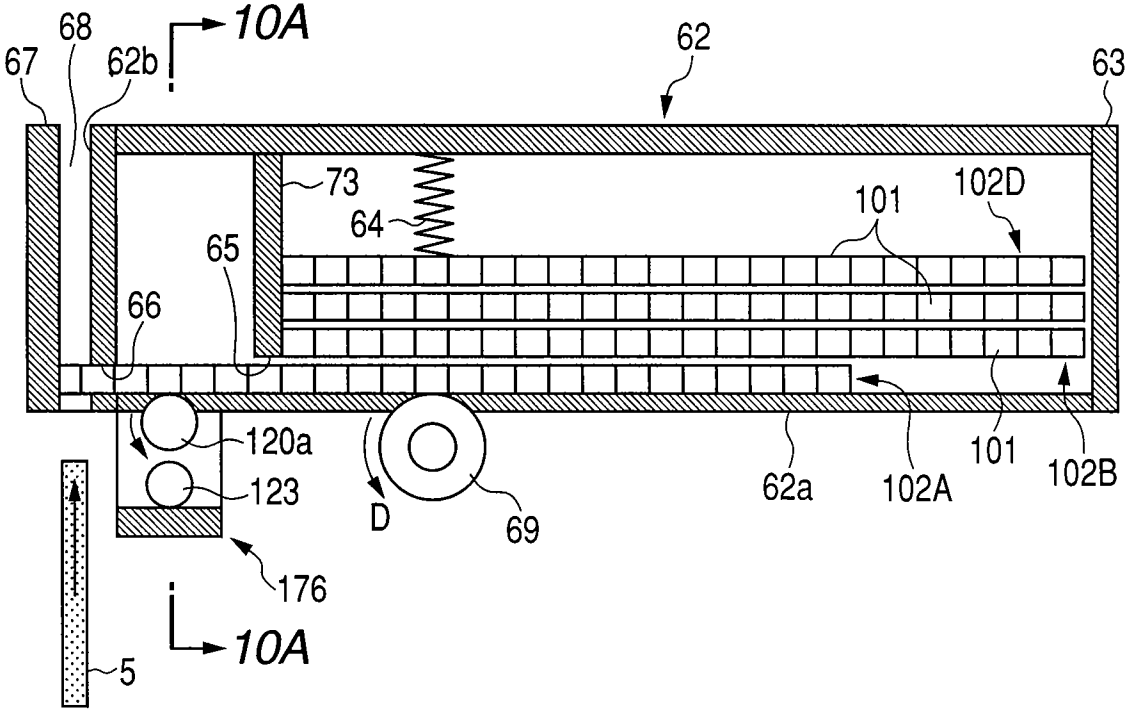
FIG. 10B is a diagram of the staple supplying portion in another embodiment provided for the stapler in FIG. 3 and is a cross sectional view taken along the staple feeding direction.
Figure 10A:
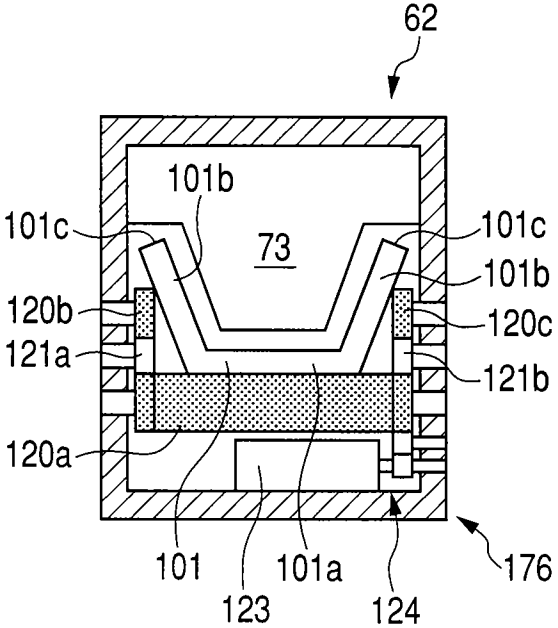
FIG. 10A is a diagram of a staple supplying portion in another embodiment provided for the stapler in FIG. 3 and is a cross sectional view in the direction which crosses the staple feeding direction (taken along the line 10A-10A in FIG. 10B).

According to the stapler 90 described above, the block staples 102 are moved by the feeding claws 70*a*, 70*b*, and 70*c*. However, as illustrated in FIGS. 10A and 10B, rollers 120*a*, 120*b*, and 120*c* may be used in place of the feeding claws 70*a*, 70*b*, and 70*c*.

That is, a motor 123 is provided for the staple holder 62. The motor 123 transfers the rotation to the roller 120*a* by a deceleration roller train 124. The roller 120*a* driven-rotates the rollers 120*b* and 120*c* through idler rollers 121*a* and 121*b*. The deceleration roller train 124, roller 120*a*, idler rollers 121*a* and 121*b*, and rollers 120*b* and 120*c* are rotatably provided for the staple holder 62.

The roller 120*a* is in contact with the pressing portion 101*a* of the staple 101. The rollers 120*b* and 120*c* are in contact with the inserting portions 101*b* of the staple 101. In this case, a plurality of rollers 120*b* and 120*c* may be provided and come into contact with the inserting portions 101*b* of the staple 101 at a plurality of positions.

The motor 123, deceleration roller train 124, idler rollers 121*a* and 121*b*, rollers 120*a*, 120*b*, and 120*c*, and the like construct, for example, a feeding portion 176 serving as a feeding unit. Gears can be also used in place of the rollers. In the case of using the gears, it is necessary that the portions which are come into contact with the block staples 102 are constructed by rollers.

When the motor 123 rotates, each of the rollers 120*a*, 120*b*, and 120*c* rotates in the direction shown by an arrow, thereby feeding the block staples 102 to the guide gap 68. Therefore, even if the length of block staples 102 becomes short, the feeding portion 176 inclines the staple 101 so that it is hardly choked into the staple holder 62, and can certainly feed the staple 101. Consequently, the stapler 90 can improve the binding efficiency of the binding-object.

According to the foregoing stapler 90, the block staples 102 are overlaid and enclosed into the staple holder 62. Therefore, the staple feed roller 69 feeds the block staples until the last block staples 102D are dropped onto the bottom portion 62*a* and the number of staples decreases. Therefore, when the number of staples 101 of the last block staples 102D decreases and the block staples 102D cannot be fed by the staple feed roller 69, the feeding portions 76 and 176 feed the block staples 102. Therefore, when the block staples 102 are overlaid and enclosed into the staple holder 62, the staple feed roller 69 is necessary. However, in the case of a stapler which encloses only one set of block staples 102 into the staple holder 62 without overlaying them, the block staples 102 can be fed only by the feeding portions 76 and 176 and the staple feed roller 69 is not always necessary.

According to the stapler described above, although the staples 101 widened toward the ends are overlaid and enclosed, the horseshoe staples 201 may be overlaid and enclosed. In this case, the guide portion 81 (FIG. 3 and FIGS. 9A to 9D) are unnecessary. The horseshoe staple 201 (FIG. 13) has: a pressing portion 201*a* for pressing the sheet bundle; and a pair of inserting portions 201*b* which are extended from the pressing portion and bent at 90° and insert the sheet bundle. Front edges 201*c* of the inserting portions 201*b* insert the binding object. The horseshoe staples 201 are also connected so that they can be separated and formed into a block shape, thereby forming block staples 202.

Figure 11:
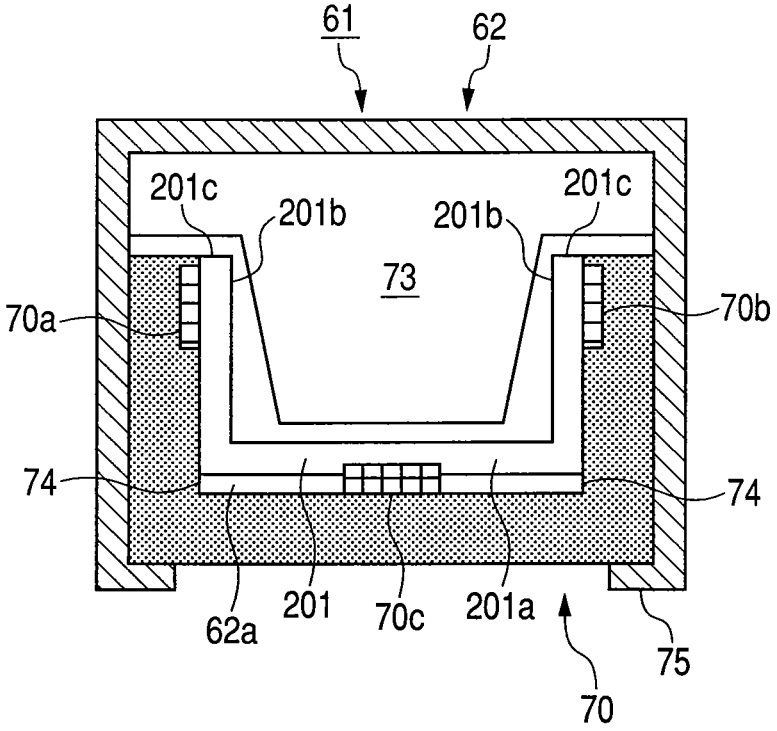
FIG. 11 is a diagram of a feeding portion at the time when the horseshoe staples can be enclosed.

As illustrated in FIG. 11, the feeding portion 76 illustrated in FIGS. 5A to 5C can also feed the horseshoe staples 201. The feeding claws 70*a* and 70*b* are come into engagement with the inserting portions 201*b* of the horseshoe staple 201 and the feeding claw 70*c* is come into engagement with the pressing portion 201*a*, thereby moving the block staples. The feeding claw 70*c* may be come into engagement with the pressing portion 201*a* at a plurality of positions. The feeding claws 70*a* and 70*b* may be come into engagement with an intermediate portion instead of portions near the front edges 201*c* of the inserting portions 201*b*. The feeding claws 70*a* and 70*b* can be also come into engagement with the inserting portions 201*b* at a plurality of positions.

Figure 12:
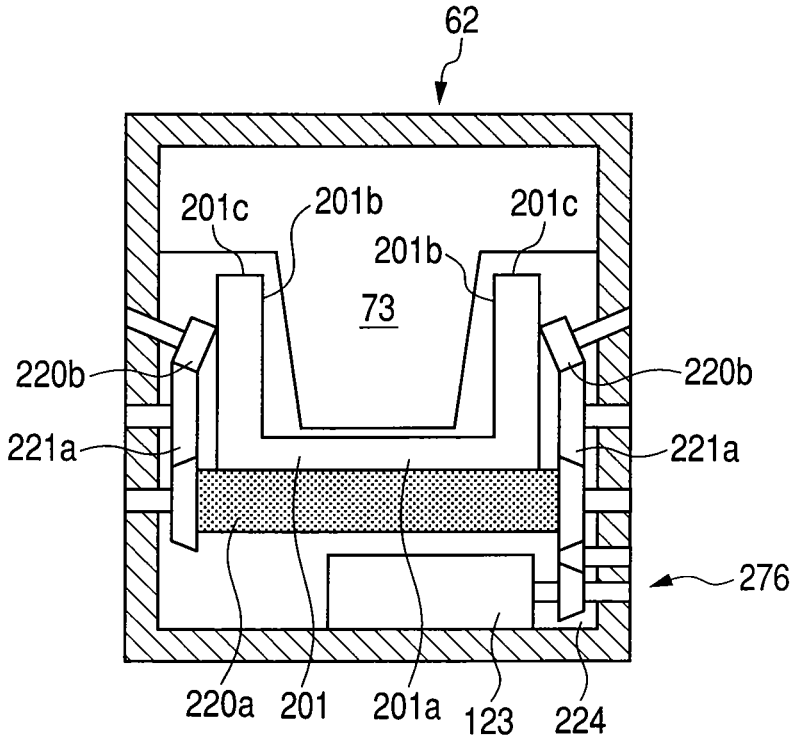
FIG. 12 is a diagram of the feeding portion at the time when the horseshoe staples can be enclosed.

FIG. 12 illustrates a feeding portion 276 serving as a feeding unit using rollers. A bevel gear-shaped roller 220*a* is in contact with the pressing portion 201*a* of the staple 201. Oblique rollers 220*b* are in contact with the inserting portions 201*b* of the staple 201.

The motor 123, a bevel gear-shaped deceleration roller train 224, roller 220*a*, bevel gear-shaped idler rollers 221*a*, the rollers 220*b*, and the like construct, for example, the feeding portion 276 serving as a feeding unit. Gears can be also used in place of the rollers. In the case of using the gears, it is necessary that the portions which are come into contact with the block staples 202 are constructed by rollers.

When the motor 123 rotates, the rollers 220*a*, 221*a*, and 220*b* rotate and feed the block staples 202 to the guide gap 68 (FIGS. 10A and 10B). Therefore, even if the length of block staples 202 becomes short, the feeding portion 276 inclines the staple 201 so that it is hardly choked into the staple holder 62, and can certainly feed the staple 201. Consequently, the stapler 90 can improve the binding efficiency of the binding object.

According to the stapler 90, the guide surfaces 81*c* for guiding the staples are provided between the inlet 81*a* and the outlet 81*b* of the guide portion 81 of the staple supplying portion 61 (FIGS. 5A to 5C) and the staples 101 which have previously been bent into the shape widened toward the ends can be used.

Therefore, according to the stapler, as compared with the stapler which bends the sheet type staples into the horseshoe shape and subsequently binds the binding object, the load at the time of driving the staple is smaller by the amount corresponding to previously-bent portion of the staple and the structure can be simplified.

According to the stapler, since the staples which have been bent into the shape widened toward the ends and can be overlaid and enclosed are used, a larger number of staples can be enclosed and the number of supplementing times of the staples can be reduced as compared with the stapler using the horseshoe staples.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-125985, filed May 10, 2007, and 2007-274248, filed Oct. 22, 2007 which are hereby incorporated by reference herein in their entirety.

What is claimed is:

1. A stapler for binding a binding object with staples having a pressing portion for pressing a binding object and a pair of inserting portions extending from opposite ends of the pressing portion and being inserted into the binding object, comprising:

an enclosing portion that encloses a plurality of block staples so as to be overlaid, each of the block staples having a plurality of the staples which are connected so that they can be separated;

a clinch portion that bends the inserting portions of a staple;

a projecting portion which projects the staple from the block staples enclosed in the enclosing portion, allows the inserting portions to be inserted through the binding object, bends the inserting portions in cooperation with the clinch portion, and binds the binding object;

a moving unit that moves a bottom block of staples among the block staples overlaid in the enclosing portion toward a projecting position where the staple is projected;

a feeding unit that feeds staples moved by the moving unit to the projecting position where the staple is projected, wherein the feeding unit comprises a moving member provided between the moving unit and the projecting position and that can move toward and away from the projecting position, with the moving member having a tapered portion that can be pressed by the projecting portion to move between a first position and a second position where the tapered portion moves from the first position by an amount corresponding to a thickness of one staple, and an engaging member provided on the moving member, with the engaging member able to engage with and be removed from between the staples of the block staples in accordance with the movement of the tapered portion from the first position to the second position, and be engaged between the staples of the block staples in accordance with the movement of the tapered portion from the second position to the first position; and an elastic member that biases the moving member toward the projecting position.

2. A stapler according to claim 1, wherein the engaging member is an elastic member that is in pressure contact with the staple.

3. A stapler for binding a binding object with staples having a pressing portion for pressing a binding object and a pair of inserting portions extending from opposite ends of the pressing portion and being inserted into the binding object, comprising:

an enclosing portion that encloses a plurality of block staples so as to be overlaid, each of the block staples having a plurality of the staples which are connected so that they can be separated;

a clinch portion that bends the inserting portions of a staple;

a projecting portion which projects the staple from the block staples enclosed in the enclosing portion, allows the inserting portions to be inserted through the binding object, bends the inserting portions in cooperation with the clinch portion, and binds the binding object;

a feeding unit that feeds staples to a projecting position where the staple is projected, wherein the feeding unit comprises a moving member that can move toward and away from the projecting position, with the moving member having a tapered portion that can be pressed by the projecting portion to move between a first position and a second position where the tapered portion moves from the first position, and an engaging member provided on the moving member, with the engaging member able to engage with and be removed from between the staples of the block staples in accordance with the movement of the tapered portion from the first position to the second position, and be engaged between the staples of the block staples in accordance with the movement of the tapered portion from the second position to the first position; and an elastic member that biases the moving member toward the projecting position.

* * * * *